US006174054B1

(12) United States Patent
Haigo

(10) Patent No.: US 6,174,054 B1
(45) Date of Patent: Jan. 16, 2001

(54) SEALING MEMBER FOR LIQUID CONTAINER

(75) Inventor: Hideaki Haigo, Nagoya (JP)

(73) Assignee: Brother Kogyo Kabushiki Kaisha, Nagoya (JP)

( * ) Notice:
Under 35 U.S.C. 154(b), the term of this patent shall be extended for 0 days.

(21) Appl. No.: 09/044,026

(22) Filed: Mar. 19, 1998

(30) Foreign Application Priority Data

Mar. 21, 1997 (JP) ..... 9-068125

(51) Int. Cl.[7] ..... B41J 2/175

(52) U.S. Cl. ..... 347/86

(58) Field of Search ..... 347/84, 85, 86, 347/87; 277/312, 630, 634

(56) References Cited

U.S. PATENT DOCUMENTS 5,786,832 * 7/1998 Yamanaka et al. ..... 347/45

FOREIGN PATENT DOCUMENTS

685340 * 12/1995 (EP) .

* cited by examiner

*Primary Examiner*—N. Le
*Assistant Examiner*—Michael Nghiem
(74) *Attorney, Agent, or Firm*—Oliff & Berridge, PLC

(57) ABSTRACT

A liquid container disclosed herein prevents the spattering of ink at the time of peeling a sealing member from a seal surface. A peeling end portion is devised such that the peeling load F gradually decreases as the peeling proceeds over first and second seal surfaces toward an end. The peeling load needs to gradually decrease over a peel ending distance at a rate of at most 0.02 kgf/mm. Such a low peeling load-decreasing rate is realized by gradual width reductions of an end portion of the seal surface, or by predetermining the manner of adhesion between the sealing member and the seal surface, such that the adhesion force per unit area gradually decreases with the progress toward an end of the seal surface. Such slow and gradual reductions in adhesion force allow a user who peels the sealing member to correspondingly adjust the speed of peeling hand movement in a final stage of the peeling. Therefore, at the time when the sealing member finally separates from the seal surface, the sealing member held by the user has been sufficiently loosened back so that substantially no backlash occurs. The spattering of ink from the sealing member and the staining of the surrounding area are thereby prevented.

20 Claims, 10 Drawing Sheets

Fig. 9 PRIOR ART
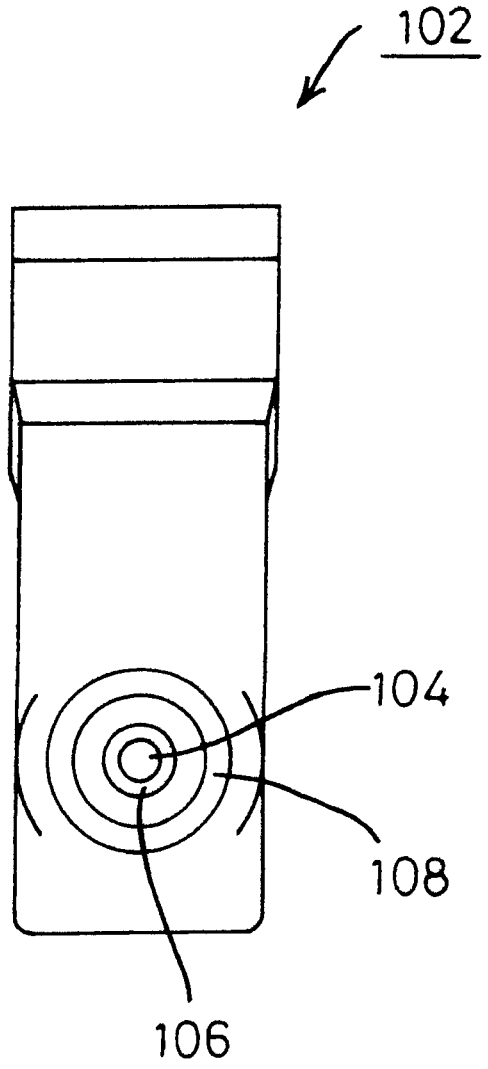

Fig. 10 PRIOR ART
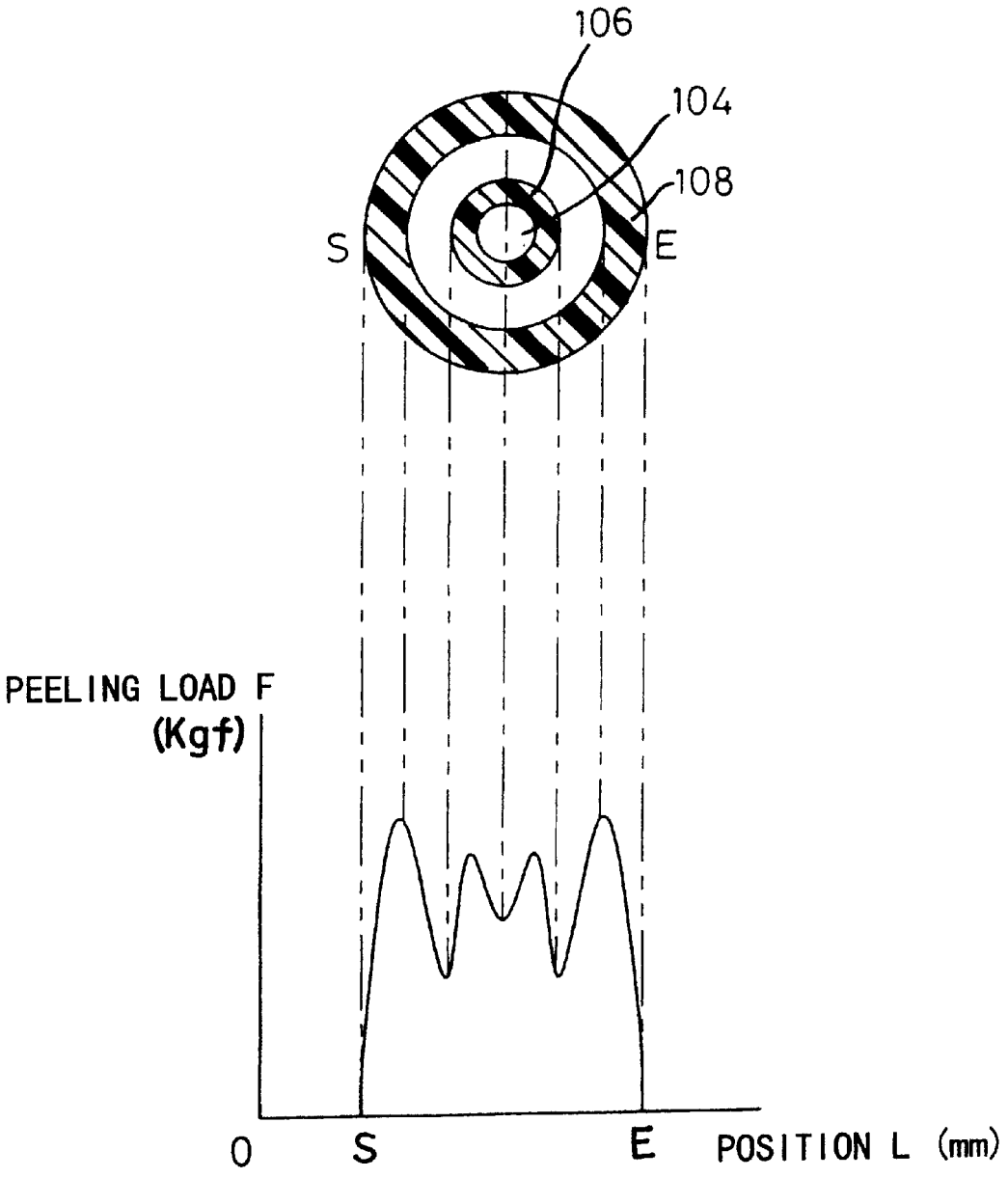

SEALING MEMBER FOR LIQUID CONTAINER

BACKGROUND OF THE INVENTION

1. Field of Invention

The invention relates to a container for a liquid and, more particularly, to an ink cartridge for use in ink jet printers and other ink jet printing devices.

2. Description of Related Art

In a conventionally known ink cartridge for use in ink jet printers, an ink supplying hole and an atmosphere communication hole are formed in portions of a cartridge case, so that ink inside the cartridge case is supplied through the ink supplying hole to an ink jet recording head provided on the side of an ink jet printer. FIG. 9 shows an ink supplying hole 104 formed in a conventional ink cartridge 102.

To prevent ink leakage through the ink supplying hole 104 or an atmosphere communication hole (not shown in FIG. 9) during transportation, the ink supplying hole 104 and the atmosphere communication hole are sealed by sealing members during manufacture.

Before setting the ink cartridge into an ink jet printer for use, a user needs to peel the sealing members covering the ink supplying hole 104 and the atmosphere communication hole off from seal surfaces 106, 108 that surround the ink supplying hole 104 or those that surround the atmosphere communication hole.

The peeling load F needed to peel a sealing member from the seal surfaces 106, 108 surrounding the ink supplying hole 104 varies depending on position L as indicated in FIG. 10. For example, in a case where the peeling is started at a position S and completed at a position E, the peeling load F sharply decreases at the end position E. Such a sharp reduction in the peeling load F causes the sealing member to contract and curl in backlash movements due to its elasticity at the time when the sealing member peels off from the seal surfaces 106, 108 surrounding the ink supplying hole 104 and, particularly, when it peels off from the outer seal surface 108. In an example case wherein the adhesion force-decreasing rate relative to the peel distance exceeds 0.02 kgf/mm, the adhesion force reduction is too rapid for a user to correspondingly adjust the user's peeling hand action, resulting in a failure to prevent a backlash of the sealing member. In such a case, there is a danger that ink deposited on the sealing member covering the ink supplying hole 104 may spatter and stain the surroundings, i.e. the nearby area or items.

Ink spattering due to the backlash of a sealing member occurs because a person strongly grips and moves the sealing member until it peels off. It is very difficult to prevent the backlash of the sealing member by, for example, moving the hand in a direction generally opposite to the peeling direction of the sealing member at the instant when the sealing member peels off. Thus it is difficult to prevent ink spattering according to the known art.

SUMMARY OF THE INVENTION

Accordingly, it is an object of the invention to provide a liquid container that prevents the spattering of a liquid, such as an ink, at the time of peeling a sealing sheet member covering an opening in the liquid container.

According to one aspect of the invention, there is provided a liquid container including a container chamber containing a liquid, an opening portion provided in an outer surface of the container chamber, and a first seal surface formed around the opening portion for sealing the opening portion with a sealing sheet member. In the liquid container, a portion of the seal surface at a position of a final stage of peeling of the sealing sheet member from the first seal surface is formed in such a shape that the width thereof decreases toward an end. When the peeling stage reaches the width-reducing end portion, the width-reducing end portion provides a time margin between an adhesion force reduction and the complete peel-off of the sealing member from the seal surface. That is, a time is allowed for a user to move his/her hand gripping the sealing member in the direction generally opposite to the peel direction in order to reduce the pulling force, and speed of peeling, on the sealing member so that ink spattering and staining of the surroundings can be prevented. At the time when the sealing member peels off, the sealing member has been sufficiently loosened, so that substantially no backlash occurs. Therefore, ink spattering and staining of the surroundings are prevented.

That is, when a user peels the sealing member sealing the opening portion, the user can adjust the movement of the hand gripping the sealing member in accordance with the peeling process of the sealing member because the adhesion force between the sealing member and the first seal surface gradually decreases. More specifically, the user can reduce the force to pull the sealing member by slowing or slightly reversing the hand movement in accordance with reductions in the adhesion force.

The liquid container of the invention may further include a second seal surface formed between the first seal surface and the opening portion. The second seal surface adheres to the sealing sheet member, and has an annular shape which surrounds the opening portion and which has a substantially consistent width. This structure provides reliable sealing for the opening portion.

Furthermore, in the liquid container of the invention, the first seal surface may have an arcuate portion and a width-reducing end portion.

The opening portion may be provided in a lower portion of a side surface of the liquid container, and a width-reducing end portion of the first seal surface may extend upward from the opening portion.

In the alternative, the width-reducing end portion of the first seal surface may extend downward from the opening portion, instead.

Furthermore, the width-reducing end portion of the first seal surface may extend in each of upward and downward directions from the opening portion.

The liquid container of the invention may further include an atmosphere communication hole that introduces external air, and a second sealing member that seals the atmosphere communication hole.

The atmosphere communication hole may instead be sealed by the same sealing member that seals the opening portion.

The liquid container may be for use as an ink cartridge of an ink jet printer.

According to another aspect of the invention, there is provided a liquid container including a container chamber containing a liquid, an opening portion provided in an outer surface of the container chamber, and a first seal surface formed around the opening portion for sealing the opening portion with a sealing sheet member. The adhesion force between the first seal surface and the sealing sheet member is predetermined in such a manner that the adhesion force decreases relative to peel distance at a rate of at most 0.02 kgf/mm, in a final stage of the peeling of the sealing sheet member from the first seal surface.

If the adhesion force-decreasing rate relative to peel distance is not greater than 0.02 kgf/mm, such a gradual reduction in adhesion force allows a user (who peels the sealing member) to correspondingly adjust the peeling hand movement. More specifically, it is possible to reduce the force to pull the sealing member by moving the hand gripping the sealing member in a generally backward direction opposite to the peeling direction thereby slowing the peeling, in accordance with reductions in adhesion force.

Therefore, at the time when the sealing member peels off, the sealing member has been sufficiently loosened, so that substantially no backlash occurs. Ink spattering and staining of the surroundings are thus prevented.

The adhesion force-decreasing rate relative to peel distance in the final stage of the peeling of the sealing sheet member from the first seal surface may be preset to at most 0.02 kgf/mm by a structure wherein a portion of the sealing sheet member at a position of the final stage gradually reduces in width.

The adhesion force-decreasing rate relative to peel distance in the final stage of the peeling of the sealing sheet member from the first seal surface may also be preset to at most 0.02 kgf/mm by a structure wherein the adhesion force per unit area of the first seal surface gradually decreases at a position of the final stage.

The liquid container of the invention may be used as an ink-containing ink cartridge for an ink jet printer.

BRIEF DESCRIPTION OF THE DRAWINGS

Preferred embodiments of the invention will be described in detail with reference to the following figures wherein:

FIG. 9 is a left side view of a conventional ink cartridge when the seal member is removed; and FIG. 10 is a diagram indicating the relationship between the configuration of a seal surface and the peeling load F in the conventional ink cartridge.

DETAILED DESCRIPTION OF PREFERRED EMBODIMENTS

Preferred embodiments of the invention will be described in detail hereinafter with reference to the accompanying drawings.

A first embodiment of the invention will be described.

Figure 1:
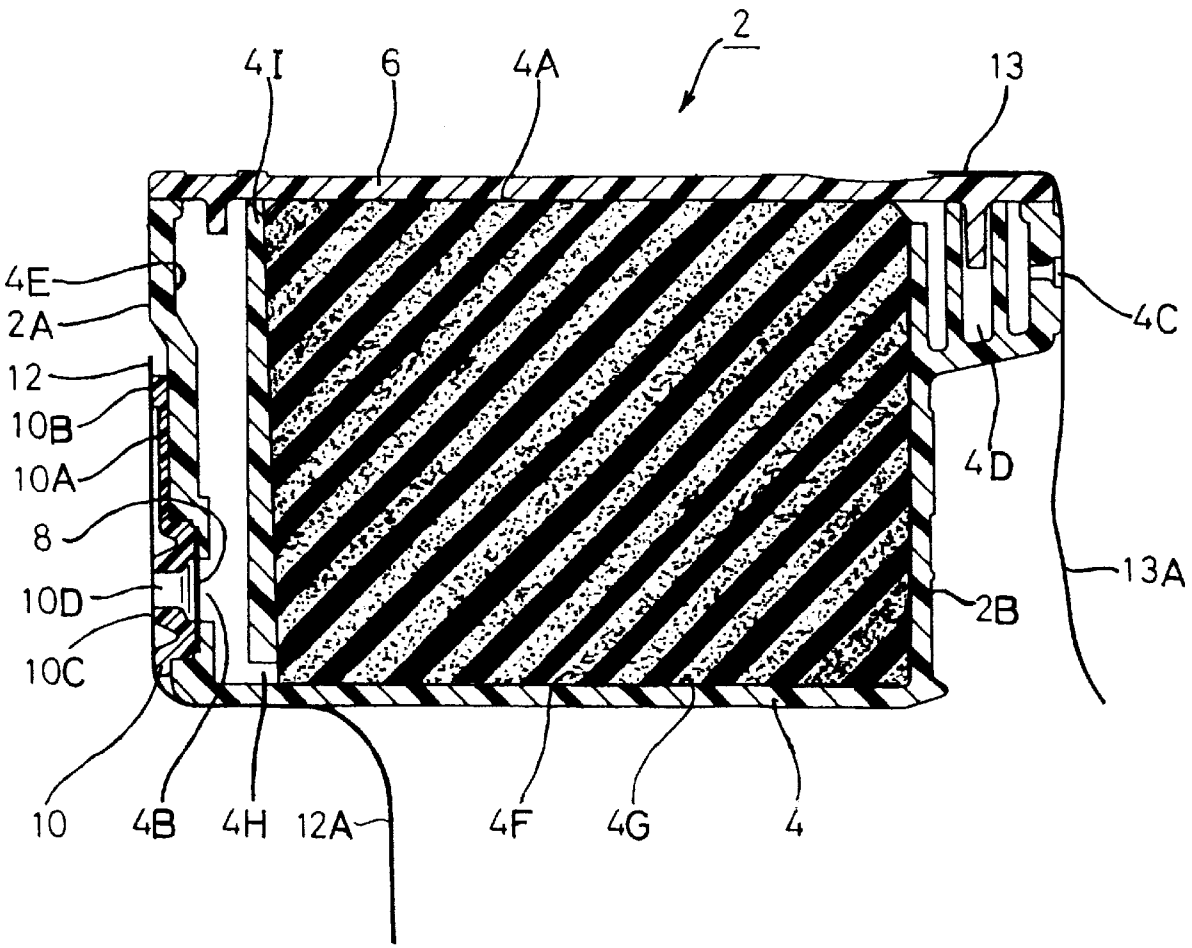
FIG. 1 is a schematic longitudinal sectional view of an ink cartridge according to a first embodiment of the invention.

FIG. 1 is a schematic longitudinal sectional view of an ink cartridge for an ink jet printer to which the invention is applied.

An ink cartridge 2 according to this embodiment is for use in an ink jet printer that prints by ejecting ink onto a recording medium. The ink cartridge 2 has a rectangular parallelopiped-shaped cartridge case 4 that has an opening 4A to the exterior. The opening 4A of the cartridge case 4 is closed by a lid member 6.

Figure 2:
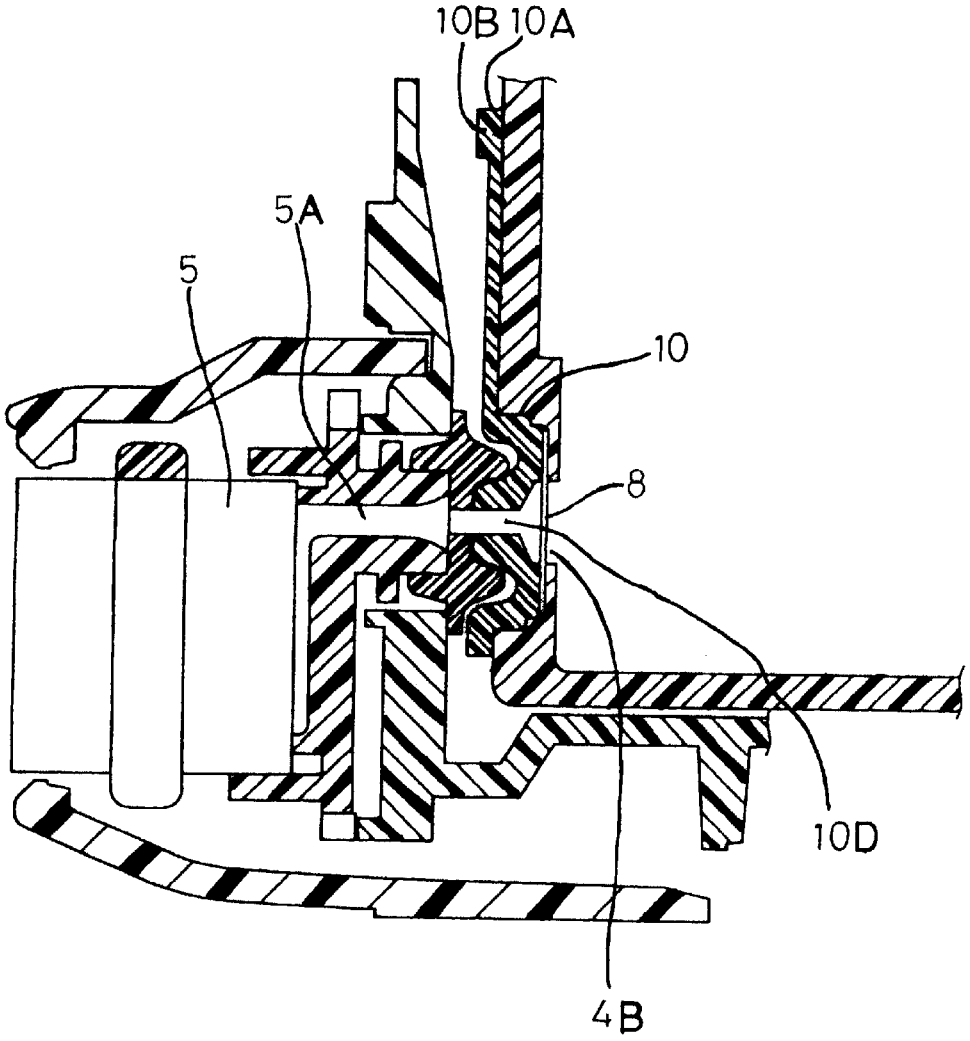
FIG. 2 is an enlarged partial view of the ink cartridge according to the first embodiment, when the ink cartridge is set for use.

A lower portion of a left side surface 2A of the cartridge case 4, as shown in FIG. 1, is provided with an ink supplying hole 4B for supplying ink into an ink supplying manifold 5A of an ink jet recording head 5 when the ink cartridge 2 is set in an ink jet printer for use, as shown in the enlarged partial view of FIG. 2. A right side surface 2B of the cartridge case 4 has an atmosphere communication hole 4C. An interior portion near the atmosphere communication hole 4C is provided with an air buffer 4D that is formed as a zigzag passage for preventing ink evaporation through the atmosphere communication hole 4C.

An interior portion of the cartridge case 4 on the side of the ink supplying hole 4B is formed as an ink chamber 4E. An interior portion of the cartridge case 4 on the side of the atmosphere communication hole 4C is formed as a foam chamber 4G which is filled with a porous member 4F (made of a foamed urethane resin in this embodiment) capable of absorbing and retaining ink. The two chambers 4E, 4G are in communication with each other through a communicating portion 4H provided in a lower portion.

The ink supplying hole 4B is provided with a mesh filter member 8 for removing dirt and other solid contaminants from ink supplied to the ink jet recording head 5 of the ink jet printer, and an adapter 10 for connecting to the ink jet recording head 5.

The adapter 10 will be described with reference to FIG. 3. The top portion of FIG. 3 is a front view of the adapter 10 of the ink cartridge 2 shown in FIG. 1, although it has been rotated 90° to more easily portray the peeling force in the bottom portion of FIG. 3.

Figure 3:
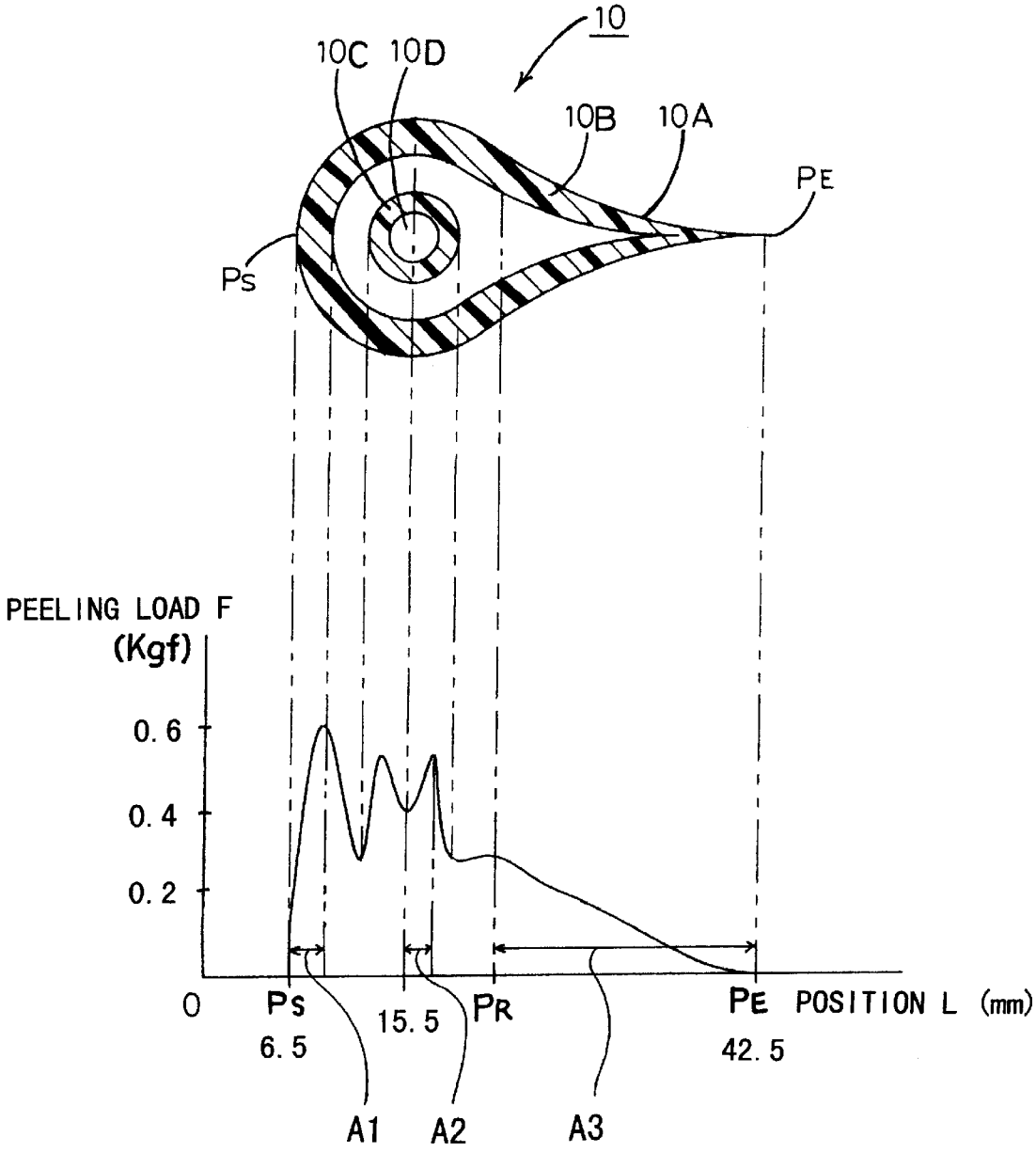
FIG. 3 is a diagram indicating the relationship between the shape of a seal surface and the peeling load F in the ink cartridge according to the first embodiment.

The adapter 10 has a configuration that combines an arc-shaped portion and a width-reducing end portion 10A extending in one direction from the arc-shaped portion, as shown in the top portion of FIG. 3. The adapter 10 has a first seal surface 10B and a second seal surface 10C. Formed in a central portion is an ejection hole 10D connecting to the ink supplying hole 4B. The first seal surface 10B has a raindrop-like annular shape that combines an arc portion and a width-reducing end portion, conforming to the contour of the adapter 10. The top surface of the first seal surface 10B is substantially flat. The second seal surface 10C has a circular ring shape extending around the circular ejection hole 10D. The top surface of the second seal surface 10C is also substantially flat.

Although the width-reducing end portion of the first seal surface 10B has a pointed end in this embodiment, the width-reducing end portion may also have a rounded end or blunt end as long as the width, that is, adhesion force, gradually reduces to a sufficiently small magnitude before the peeling end is reached.

Figure 4:
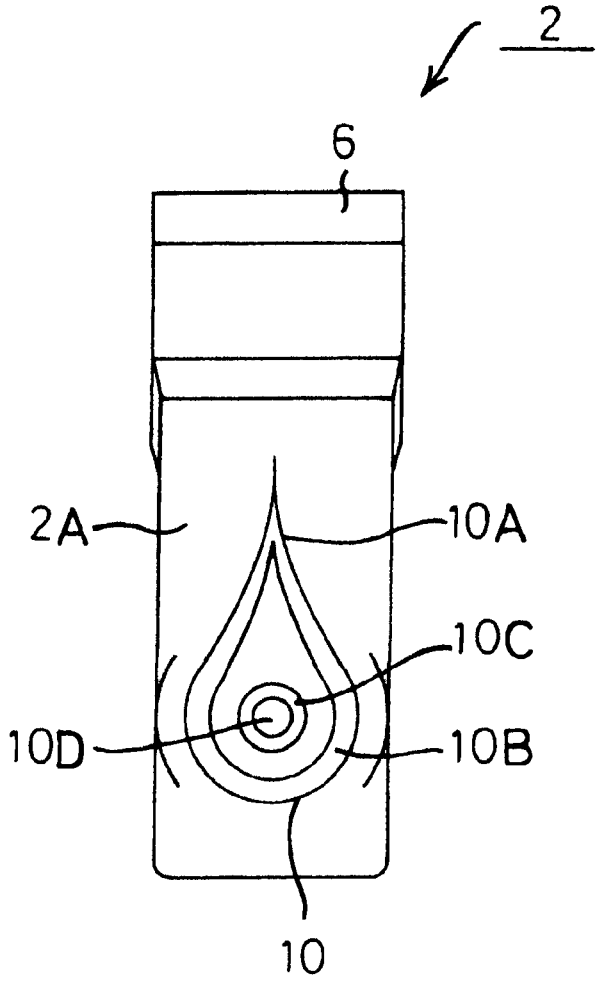
FIG. 4 is a left side view of the ink cartridge when the sealing member is removed.

The width-reducing end portion 10A of the adapter 10 extends toward the lid member 6 as shown, in the view of the left side of FIG. 1 of the ink cartridge 2 and in FIG. 4. The adapter 10 is fixed to the left side surface 2A of the ink cartridge 2 by hot welding or the like.

The ink cartridge 2 is produced by the following processes.

Figure 5A:
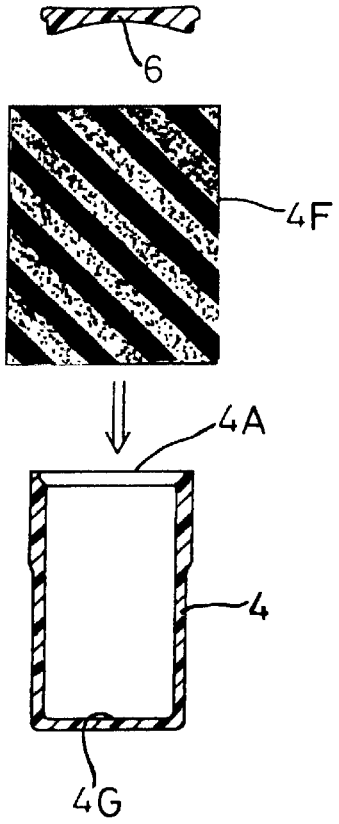
FIGS. 5A and 5B illustrate steps of the production process of the ink cartridge.
Figure 5B:
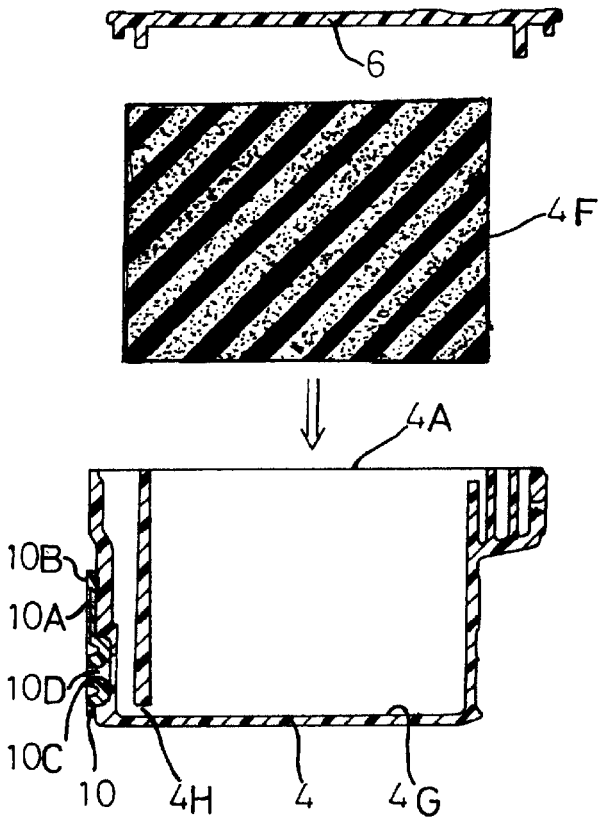

Referring to FIGS. 5A and 5B, the porous member 4F is first packed in a compressed condition into the foam chamber 4G of the cartridge case 4 from the opening 4A formed in a side (upper side) of the cartridge case 4. After the lid member 6 is hot-welded to the opening 4A of the cartridge case 4, deaerated ink is charged into the ink cartridge 2 through the ink supplying hole 4B (FIG. 1) by an ink injecting device (not shown). The sectional view of FIG. 5A is taken on a vertical plane perpendicular to the plane of the sheet of the drawing of FIG. 5B, and viewed from the left in FIG. 5B.

The ink injection process is performed as follows.

First, the ink injecting device (not shown) is connected to the ink supplying hole 4B. Before ink is injected, a negative pressure is applied to the atmosphere communication hole 4C (FIG. 1) so that a negative pressure is established in the ink cartridge 2.

When a predetermined negative pressure (for example, about −710 mmHg based on an assumption that 1 atm is 0 mmHg) is established in the ink cartridge 2, ink injection by the ink injecting device is started. Because the pressure inside the ink cartridge 2 is negative, ink is readily drawn into the ink cartridge 2 when injected. The injected ink strikes a partition wall 41 (FIG. 1) that separates the foam chamber 4G and the ink chamber 4E, so that a portion of the ink flows upward and another portion flows downward. In the beginning, most ink flows into the ink chamber 4E and fills the ink chamber 4E. Then, ink flows into the foam chamber 4G through the communicating portion 4H between the end of the partition wall 41 and the bottom of the cartridge case 4. Ink thus penetrates into the porous member 4F in the foam chamber 4G, thereby impregnating the porous member 4F.

Finally, a sealing member 12 is hot-welded to the first and second sealing surfaces 10B, 10C surrounding the ink supplying hole 4B, and another sealing member 13 is hot-welded to the surface of the cartridge case 4 surrounding the atmosphere communication hole 4C, thereby completely sealing the ink supplying hole 4B and the atmosphere communication hole 4C. The sealing member 12 over the ink supplying hole 4B, is also hot-welded down to a bottom portion of the cartridge case 4 leaving an end portion 12A of the sealing member 12 that is not hot-welded. Similarly, an end portion 13A of the sealing member 13 over the atmosphere communication hole 4C is not hot-welded to the cartridge case 4. The end portions 12A, 13A are left free for a user to grip to pull and peel the sealing members 12, 13 from the cartridge case 4.

The sealing member 12 is substantially uniformly adhered by hot welding to the first seal surface 10B and the second seal surface 10C indicated by hatching in the top portion of FIG. 3.

To use the ink cartridge 2, first the sealing member 13 is peeled from the area of the atmosphere communication hole 4C of the ink cartridge 2 by gripping and pulling the end portion 13A.

Subsequently, the sealing member 12, over the ink supplying hole 4B, is peeled from the first seal surface 10B and the second seal surface 10C of the adapter 10 by gripping and pulling the end portion 12A of the sealing member 12. The peeling load F needed to peel the sealing member 12 varies as indicated in the bottom portion of FIG. 3.

Referring to the bottom portion of FIG. 3, as the peeling starts at a point PS on an arcuate portion of the first seal surface 10B, the peeling load F rapidly increases as the peel distance increases. As the position of peeling shifts, the peeling load F varies over relatively wide ranges in accordance with the shapes of the first seal surface 10B and the second seal surface 10C.

In the width-reducing end portion 10A at a final peeling position, the peeling load F gradually decreases as the peeling proceeds from a beginning point PR to an end point PE of the width-reducing end portion 10A. Referring to the graph at the bottom portion of FIG. 3, within a range A3 from the beginning point PR to the end point PE of the width-reducing end portion 10A, the peeling load F decreases at a substantially constant gradient. According to an experiment by the inventors, the decreasing rate was 0.016 kgf/mm. If the peeling load F decreases gradually at a substantially constant rate, a time period can be created before the sealing member 12 completely peels off from the first seal surface 10B. During such a time period, it is possible to slow or reverse the movement of the gripping hand to reduce the pulling force on the sealing member. Therefore, at the time when the sealing member peels off, the sealing member has been sufficiently loosened back, so that substantially no backlash occurs. Ink spattering and staining of surroundings are thus prevented.

Based on the aforementioned experimental result that the peeling load-decreasing rate of 0.016 kgf/mm did not cause a backlash of the sealing material, it should be appropriate to assume that a rounded value of 0.02 kgf/mm is a substantially maximum level of the decreasing rate of peeling load F to achieve the intended effect, that is, substantial prevention of a backlash of a sealing material.

The gradual reduction in peeling load F indicated in FIG. 3B is achieved by gradual width reductions of the first seal surface 10B toward the end point PE. Merely for reference, the peeling load F varies approximately at a rate of 0.22 kgf/mm in a range A1, and approximately at a rate of 0.07 kgf/mm in a range A2, as shown in the graph at the bottom portion of FIG. 3.

Thus, this structure of the embodiment allows a user who peels the sealing member to adjust the peeling hand movement in accordance with the reduction in the adhesion force, which occur gradually and slowly according to the embodiment. That is, it is possible to slow or reverse the peeling hand movement to reduce the pulling force in accordance with the reduction in adhesion force. More specifically, if the decreasing rate of the peeling load F is not greater than 0.02 kgf/mm, it is possible to slowly peel the sealing member 12 from the first seal surface 10B and the second seal surface 10C.

Therefore, at the time when the sealing member 12 peels off, the sealing member 12 has been sufficiently loosened back, so that substantially no backlash occurs. The spattering of ink from the sealing member 12 and the staining of surroundings can thereby be prevented.

Furthermore, the second seal surface 10C, surrounded by the first seal surface 10B, blocks ink leaks from the ink supplying hole 4B, achieving a sufficient seal to prevent ink leakage.

A second embodiment of the invention will now be described.

Figure 6:
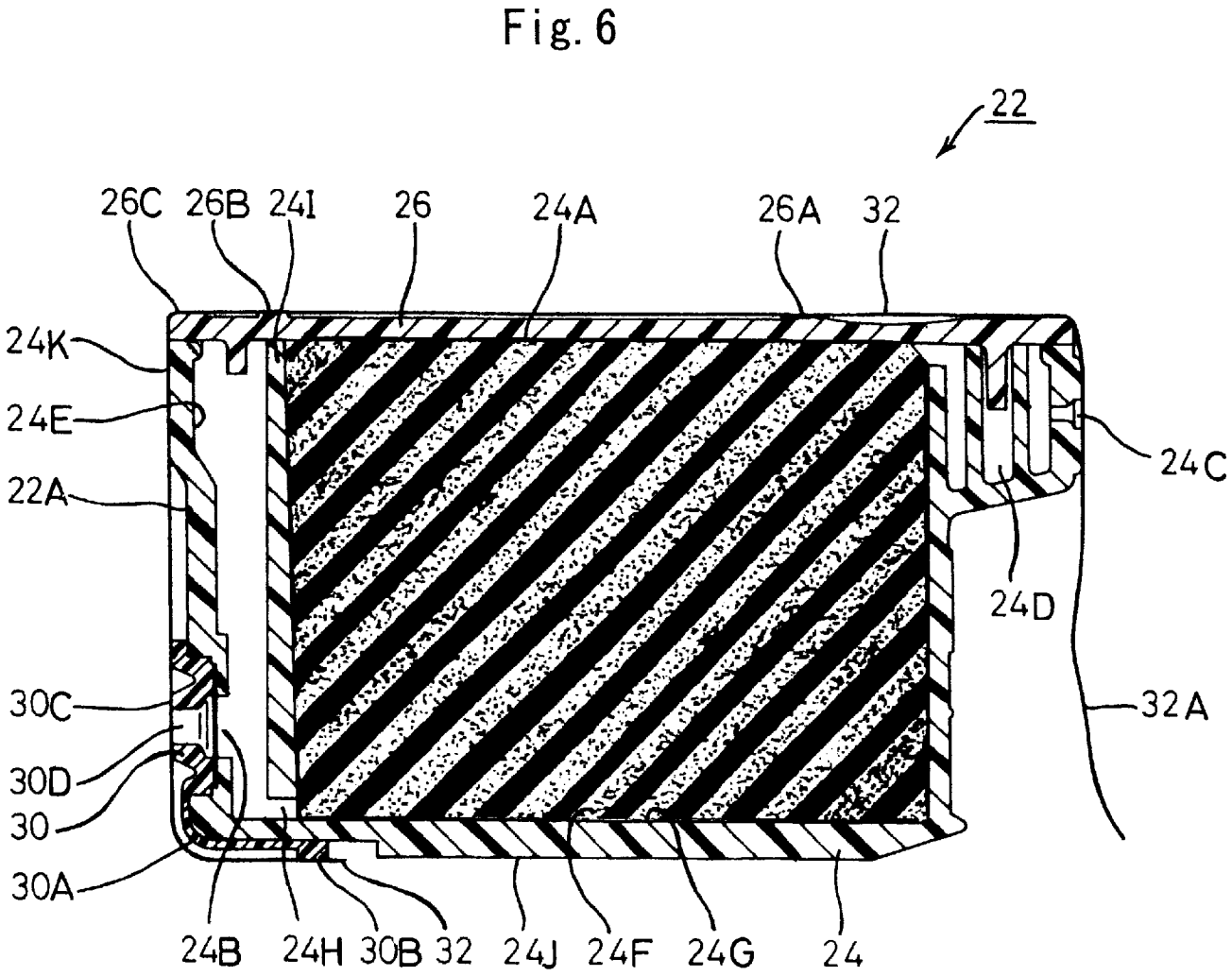
FIG. 6 is a schematic longitudinal sectional view of an ink cartridge according to a second embodiment of the invention.
Figure 7:
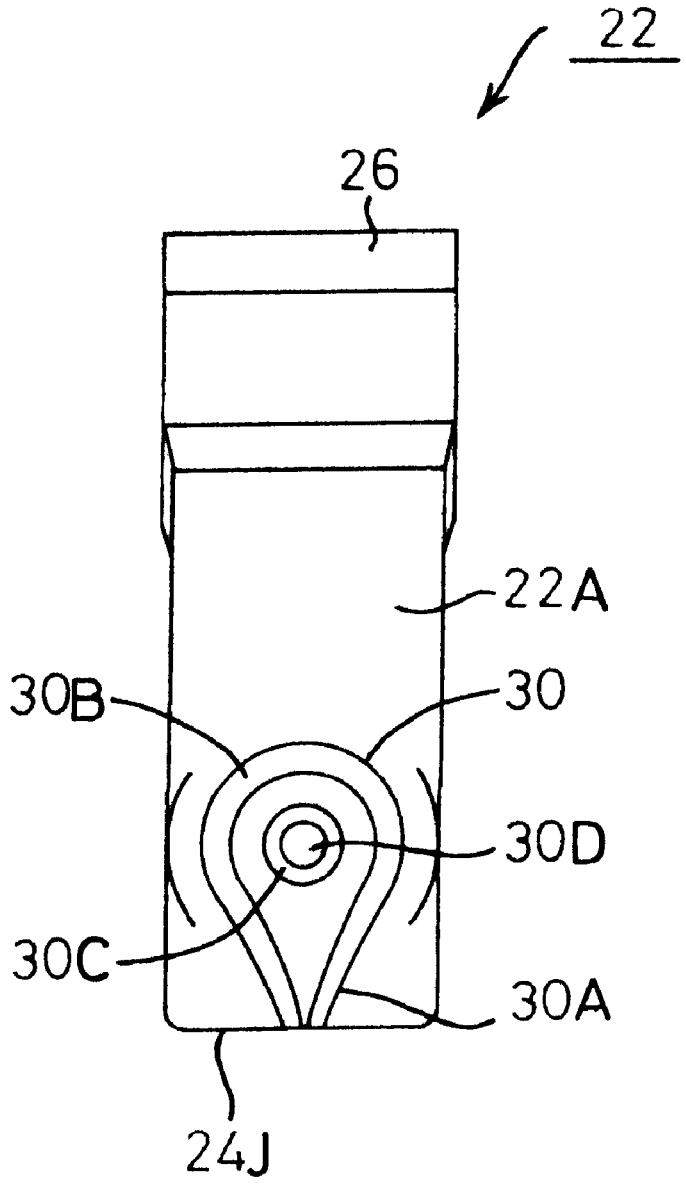
FIG. 7 is a left side view of the ink cartridge according to the second embodiment, when the sealing member is removed.

An ink cartridge 22 according to the second embodiment differs from the ink cartridge 2 of the first embodiment in that, as shown in FIGS. 6 and 7, a width-reducing end portion 30A of an adapter 30 extends downward from a left side surface 22A (as viewed in FIG. 6) of the ink cartridge 22 to a bottom surface 24J of a cartridge case 24. Furthermore, in the second embodiment, only one sealing member 32 is provided for sealing an atmosphere communication hole 24C and the adapter 30. The remaining structure of the second embodiment is substantially the same as that of the first embodiment.

Portions of the second embodiment comparable to those of the first embodiment are represented by reference numerals obtained by adding 20 to the reference numerals of the comparable portions of the first embodiment. The adapter 30 has a configuration that combines an arc-shaped portion and the width-reducing end portion 30A extending in one direction from the arc-shaped portion as shown in FIG. 7. The adapter 30 has a first seal surface 30B and a second seal surface 30C. Formed in a central portion is an ejection hole 30D connecting to an ink supplying hole 24B. The first seal surface 30B has a raindrop-like annular shape that combines an arc portion and a width-reducing end portion, conforming to the contour of the adapter 30. The second seal surface 30C has a circular ring shape extending around the circular ejection hole 30D. The width-reducing end portion 30A of the adapter 30 extends on the left side surface 22A of the ink cartridge 22 to the bottom surface 24J (of FIG. 6), as shown in the frontal view of FIG. 7. The adapter 30 is fixed to the left side surface 22A of the ink cartridge 22 by hot welding or the like.

To peel the sealing member 32 shown in FIG. 6 before using the ink cartridge 22, a free end portion 32A extending on the side of the atmosphere communication hole 24C is gripped and pulled. Thereby, the atmosphere communication hole 24C is first exposed. The sealing member 32 is then peeled off from adhering portions 26A, 26B, 26C provided on the lid member 26 and an adhering portion 24K provided on the cartridge case 24. The sealing member 32 is finally peeled off from the second seal surface 30C and the first seal surface 30B of the adapter 30.

During the peeling, slow and gradual changes in the peeling force F occur as indicated FIG. 3B, similar to the case of the first embodiment. At the time when the sealing member 32 peels off from the ink cartridge 22, the sealing member 32 has been sufficiently loosened back, so that substantially no backlash occurs. Thus, the spattering of ink from the sealing member 32 and the staining of surroundings thereby are prevented. The second embodiment also achieves substantially the same advantages as achieved by the first embodiment.

Moreover, since the ink cartridge 22 of the second embodiment employs only one sealing member, the peeling of a sealing member prior to use can be more efficiently accomplished.

Figure 8:
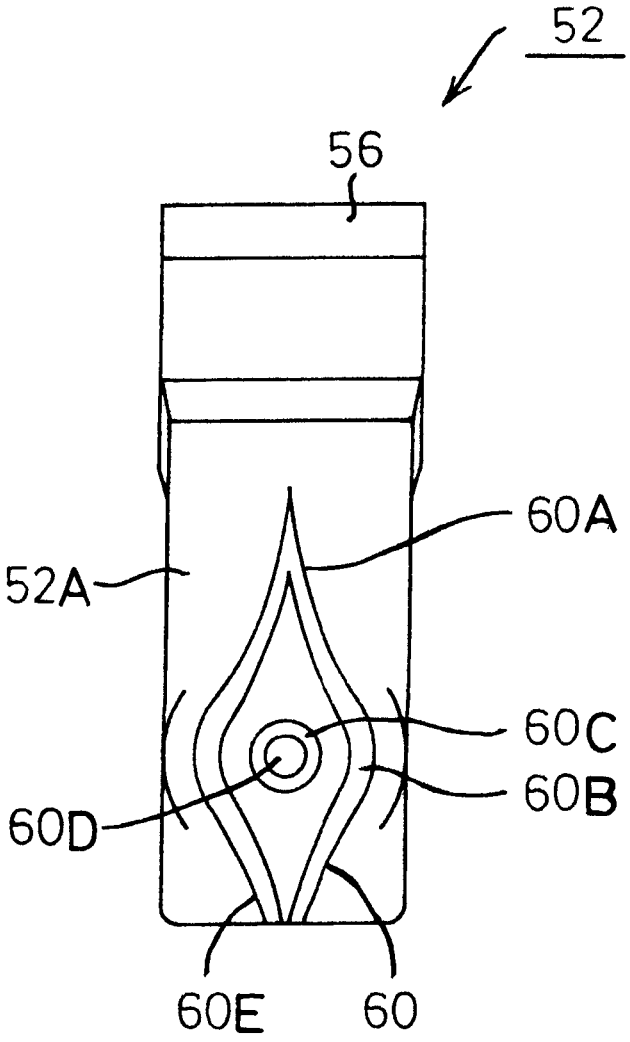
FIG. 8 is a left side view of an ink cartridge according to a third embodiment, when the sealing member is removed.

A third embodiment of the invention will now be described with reference to FIG. 8.

An ink cartridge 52, according to the third embodiment, is structured so that a sealing member can be peeled in either direction. More specifically, an ejection hole 60D is surrounded by a second seal surface 60C and a first seal surface 60B that extends around the circular second seal surface 60C. The first seal surface 60B has two width-reducing end portions 60A, 60E that extend upward and downward, respectively.

If the peeling proceeds downward, the width-reducing end portion 60E prevents ink spattering. If the peeling proceeds upward, the width-reducing end portion 60A prevents ink spattering. Thus, the third embodiment prevents ink spattering in either of the peeling directions.

In the first to third embodiments, adhesion force-decreasing rates of 0.02 kgf/mm or less relative to peel distance are realized by gradual width reductions of the first seal surfaces 10B, 30B, 60B at a position of a final peeling stage.

Besides this method, in which adhesion force-decreasing rates of 0.02 kgf/mm or less are realized by the shapes of the first seal surfaces 10B, 30B, 60B, it is also possible to employ a method in which an adhesion force-decreasing rate of at most 0.02 kgf/mm is realized by correspondingly reducing the adhesion force per unit area with the progress toward an end of the first seal surface. For example, such reductions in adhesion force per unit area can be realized by correspondingly varying the rate of hot welding between the first seal surface 10B and the sealing member 12.

It is also possible to employ both the method based on the shape of the first seal surface and the method based on variation in adhesion force per unit area.

Although, in the first to third embodiments, the shapes of the seal surfaces 10B, 10C, 30B, 30C, 60B, 60C are determined by the configurations of the adapters 10, 30, 60, the actual configurations of the adapters 10, 30, 60 do not need to correspond to the aforementioned adhesion force-decreasing rate. The requirement is that the adhered seal areas have shapes similar to those of the seal surfaces 10B, 10C, 30B, 30C, 60B, 60C. Therefore, it is also possible to realize an adhesion force-decreasing rate of 0.02 kgf/mm relative to peel distance by correspondingly predetermining the shapes of adhered areas.

It is to be understood that the invention is not restricted to the particular forms shown in the foregoing embodiments. Various modifications and alternations can be made thereto without departing from the scope of the invention encompassed by the appended claims.

What is claimed is:

1. A liquid container sealed by a sealing sheet member, comprising:

a container chamber containing a liquid;

an opening portion provided in an outer surface of the container chamber; and a first seal surface formed around the opening portion for sealing the opening portion with the sealing sheet member, a portion of the first seal surface at a position of a final stage of peeling of the sealing sheet member from the first seal surface being formed in such a shape that width thereof decreases toward an end.

2. The liquid container according to claim 1, further comprising a second seal surface formed between the first seal surface and the opening portion, the second seal surface adhering to the sealing sheet member and having an annular shape that surrounds the opening portion and has a substantially consistent width.

3. The liquid container according to claim 1, wherein the first seal surface has an arcuate portion and a width-reducing end portion.

4. The liquid container according to claim 1, wherein the opening portion is provided in a lower portion of a side surface of the liquid container, and wherein a width-reducing end portion of the first seal surface extends upward from the opening portion.

5. The liquid container according to claim 1, wherein the opening portion is provided in a lower portion of a side surface of the liquid container, and wherein a width-reducing end portion of the first seal surface extends downward from the opening portion.

6. The liquid container according to claim 1, wherein the opening portion is provided in a lower portion of a side surface of the liquid container, and wherein a width-reducing end portion of the first seal surface extends in each of upward and downward directions from the opening portion.

7. The liquid container according to claim 1, further comprising an atmosphere communication hole that introduces external air, and a second sealing member that seals the atmosphere communication hole.

8. The liquid container according to claim 1, further comprising an atmosphere communication hole that introduces external air, the atmosphere communication hole being sealed by the same sealing member that seals the opening portion.

9. The liquid container according to claim 1, wherein the liquid container is for use as an ink cartridge of an ink jet printing apparatus.

10. The liquid container according to claim 1, wherein the first seal surface has a width-reducing pointed end portion.

11. A liquid container sealed by a sealing sheet member, comprising:

a container chamber containing a liquid;

an opening portion provided in an outer surface of the container chamber; and a first seal surface formed around the opening portion for sealing the opening portion with the sealing sheet member that is peeled off when the liquid container is used, the first seal surface having a configuration such that the adhesion force between the first seal surface and the sealing sheet member decreases relative to peel distance at a rate of at most 0.02 kgf/mm, in a final stage of the peeling of the scaling sheet member from the first seal surface wherein the adhesion force-decreasing rate relative to peel distance in the final stage of the peeling of the sealing sheet member from the first seal surface is preset to at most 0.02 kgf/mm by gradual width reductions of a portion of the sealing sheet member at a position of the final stage.

12. The liquid container according to claim 11, wherein the adhesion force-decreasing rate relative to peel distance in the final stage of the peeling of the sealing sheet member from the first seal surface is preset to at most 0.02 kgf/mm by gradual reductions in the adhesion force per unit area of the first seal surface at a position of the final stage.

13. The liquid container according to claim 11, wherein the adhesion force decreases relative to peel distance at a rate of at most 0.016 kgf/mm, in a final stage of the peeling of the sealing sheet member from the first seal surface.

14. The liquid container according to claim 11, wherein the adhesion force decreases relative to peel distance at a rate of at most 0.02 kgf/mm just before the sealing sheet member is perfectly peeled from a first seal surface.

15. A liquid container, comprising:

a case cartridge having a pair of opposing side walls, a pair of opposing end walls, a bottom wall and a lid member mounted at an upper edge of the pair of side walls and the pair of end walls, a liquid opening in a portion of one end wall near the bottom wall and an air opening in one of the other end wall of the pair of end walls and one side wall of the pair of side walls near the lid member;

a sealing surface disposed around the liquid opening; and a sealing member adhered to the sealing surface, the sealing surface configured such that a force of adherence between the sealing surface and the sealing member decreases in a direction of removal of the sealing member, wherein the sealing surface has a width-reducing end portion extending in the direction of removal of the sealing member.

16. The liquid container according to claim 15, wherein the sealing surface comprises:

an inner seal surface surrounding the liquid opening; and an outer seal surface surrounding the inner seal surface.

17. The liquid container according to claim 16, wherein the outer seal surface has a rain drop shape comprising an arc portion at an upstream side and a width-reducing portion at a downstream side in the direction of removal of the sealing member.

18. The liquid container according to claim 17, wherein an end of the width reducing portion may be one of pointed, blunted, and rounded.

19. The liquid container according to claim 16, wherein the force of adherence between the sealing surface and the sealing member decreases at a rate no greater than 0.02 kgf/mm in final stages of removal of the sealing member.

20. The liquid container according to claim 15, wherein the air opening is in the other end wall of the pair of end walls and the sealing member seals both the air opening and the liquid opening.

* * * * *